United States Patent [19]

Medgvesy

[11] Patent Number: 4,701,103

[45] Date of Patent: Oct. 20, 1987

[54] TURBOMACHINE HOUSING

[75] Inventor: Stephen Medgvesy, Andelfingen, Switzerland

[73] Assignee: Sulzer Brothers Limited, Winterthur, Switzerland

[21] Appl. No.: 708,521

[22] Filed: Mar. 5, 1985

[30] Foreign Application Priority Data

Mar. 19, 1984 [CH] Switzerland ..... 1370/84

[51] Int. Cl.[4] ..... F01D 25/24

[52] U.S. Cl. ..... 415/219 C

[58] Field of Search ..... 415/219 C, 219 R, 201; 285/360, 376, 401; 220/328

[56] References Cited

U.S. PATENT DOCUMENTS

| | | | |
|---|---|---|---|
| 1,128,474 | 2/1915 | Martz | 285/376 |
| 1,873,621 | 8/1932 | Moore | 285/376 |
| 1,947,743 | 2/1934 | Schoeneck | 285/401 |
| 1,962,400 | 6/1934 | McWane | 285/376 |
| 2,296,710 | 9/1942 | Fischer | 220/328 |
| 2,376,566 | 5/1945 | Woodling | 285/376 |
| 2,647,768 | 8/1953 | Exton | 285/376 |
| 3,690,505 | 9/1972 | Schoonman et al. | 220/328 |
| 3,874,814 | 4/1975 | Carroll et al. | 415/201 |
| 3,934,752 | 1/1976 | Raviccio et al. | 415/219 C |
| 4,347,945 | 9/1982 | Fehlau | 220/328 |

*Primary Examiner*—Louis J. Casaregola
*Assistant Examiner*—Timothy S. Thorpe
*Attorney, Agent, or Firm*—Kenyon & Kenyon

[57] ABSTRACT

The pressure cover has a plurality of radially outwardly directed teeth while the housing has a corresponding plurality of inwardly directed teeth. The cover can be inserted past the housing teeth and then rotated to bring the teeth into alignment for closing off the housing. In addition, a flange ring is provided to seal a gap between the cover and housing and the sealing means are disposed between the flange ring and the cover and housing, respectively. The sealing means can be replaced without having to detach the cover.

4 Claims, 3 Drawing Figures

TURBOMACHINE HOUSING

This invention relates to a turbomachine housing.

As is known, various types of housings have been provided for turbomachines, such as pumps, compressors or turbines. In many cases, the housings have been constructed with an open end which is closed by a pressure cover with the interposition of elastic sealing elements such as elastomer O-rings, metallic C-rings, flat or spiral seals for example in the dividing gap between the housing and cover in order to seal the interior of the machine from the surrounding environment. In one type of construction, the pressure cover which closes off the housing on the end face, usually from the driving end, is provided with a driving flange and is secured to the housing by means of large expansion bolts and, possibly nuts. In this case, the sealing elements for sealing the pressure against the outside environment are in the form of elastic flat seals or O-rings disposed between the cover and the housing. Such a construction is described in Swiss Pat. No. 562,405. However, these constructions require salient flanges on the housing cover to receive the expansion bolts and, therefore, a relatively large housing. Further, the entire cover must be removed for replacement of the seals.

In other constructions, such as described in Hitachi Review vol. 30, 1981, No. 6, page 6, FIG. 2, a housing cover is equipped with radial O-rings and is inserted into the housing in an axial direction. In this case, the cover is held by shear rings which are split in the circumferential direction. These shear rings, in turn, are fixed by a retention means fastened on the housing, which retention is also screwed to the housing cover. This construction is, however, very complicated and requires considerable effort for disassembly and reassembly, for example, to replace the O-rings. Moreover, the radial O-rings are exposed to considerable danger of damage during insertion of the cover into the housing.

Accordingly, it is an object of the invention to provide a simple, easy and space-saving construction for the cover and housing of a turbomachine, for example a pump in which seals can be replaced without disassembly of the cover.

It is another object of the invention to provide a relatively simple construction of machine or pump housing and cover which can be readily assembled and disassembled.

It is another object of the invention to be able to replace the sealing means between the housing and cover without need to remove the cover.

It is another object of the invention to provide a relatively simple technique for mounting a cover in a centrifugal pump housing.

Briefly, the invention provides a turbomachine housing having an open end which defines a cavity for receiving machine components with a plurality of radially inwardly directed teeth circumferentially spaced at the open end and a cover which is disposed within the open end of the housing to close the cavity with a plurality of radially outwardly directed teeth coaxially abutting the teeth of the housing.

In addition, a flange ring is mounted circumferentially on the cover and is secured to the end of the housing. Further, a sealing means is disposed between the ring and the housing while another sealing means is disposed between the ring and the cover.

The cover is sized to correspond to the clearance of the teeth on the housing so that the cover can be moved into and out of the housing with the teeth of the cover interposed between the teeth of the housing, i.e. with the teeth of the housing and cover in non-aligned relation.

In this construction, the teeth of the housing and the teeth of the cover are brought into coincidence or abutment by a rotation of the cover. In this way, the pressure developed during operation of the machine is absorbed by the tooth connection. The sealing of the pressure is effected by the two elastic sealing means which are mounted and held by the flange ring. In this respect, the sealing means may each be formed by an elastomer packing such as an O-ring.

A rather simple slide-in unit can also be formed, in part, by the cover for assembly of the machine or pump. To this end, the slide-in unit is comprised of a rotor assembly, a stator assembly having means defining threaded bores therein, and the cover. In this case, at least some of the teeth on the cover have an axially disposed bore therethrough and bolts are passed through these bores into threaded engagement with the threaded bores in the stator assembly. Such a slide-in unit can be readily slid into place in the housing. Once in place, the bolts can be unthreaded so as to permit the cover to be rotated relative to the teeth of the housing in order to bring the respective sets of teeth into alignment and coaxial abutment.

The construction does not require salient flanges or large expansion bolts. Hence, the cover and the housing can be made smaller than previously known constructions. In addition, the risk of damage to the sealing means can be reduced or practically precluded. Moreover, replacement of the sealing means should leaks occur over time does not require disassembly of the housing cover. Instead, only the flange ring need be removed in order to replace the sealing means.

In addition, at least some of the teeth on the housing may include an axially disposed bore. Thus, should the teeth of the cover and housing become firmly connected together, for example by sticking, a hydraulic pressure medium may be delivered through these bores in order to separate the abutting pressure cover and housing teeth for disassembly of the cover from the housing prior to rotation of the cover relative to the housing.

These and other objects and advantages of the invention will become more apparent from the following detailed descrition taken in conjunction with the accompanying drawings wherein.

Figure 1:
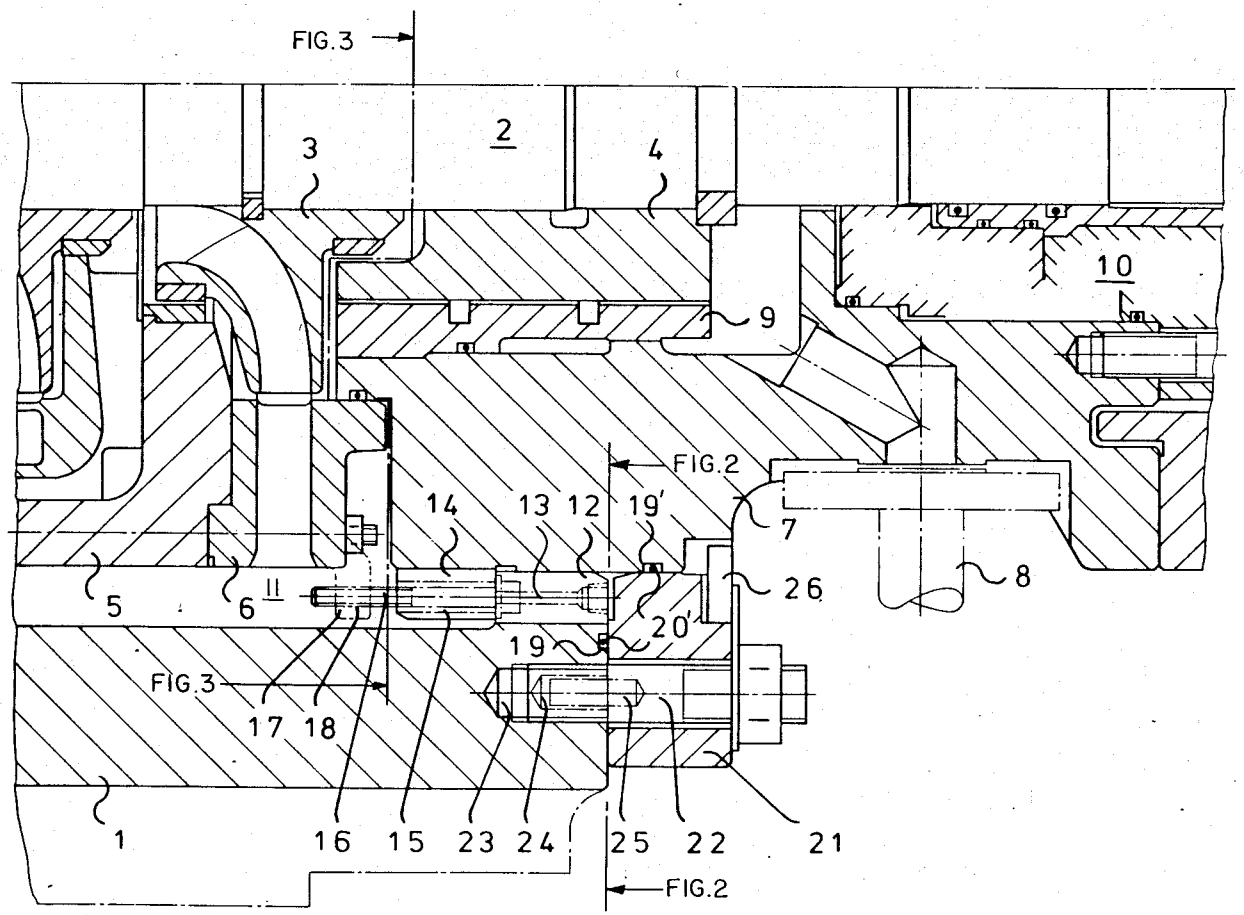
FIG. 1 illustrates a part cross sectional view of a housing and cover of a centrifugal pump as constructed in accordance with the invention.

Referring to FIG. 1, the centrifugal pump housing 1 houses a rotor assembly which is composed of a shaft 2, a plurality of rotors 3 which are secured to the shaft 2 and a relief piston 4 which is mounted on the shaft 2. In addition, the housing 1 receives a stator assembly composed of a stepped housing 5, a stator 6 for each rotor stage and a bushing 9 rotatably receiving the relief piston 4 which, as is known, functions as a pressure equalization piston for receiving possible axial shifting.

The housing 1 has an open end defining a cavity 11 for receiving the centrifugal pump components, i.e. the rotor assembly and stator assembly and is closed off by a pressure cover 7 at that end. As indicated, a pressure compensation line 8 opens into the cover 7 to communicate with the cavity 11. In addition, a slide ring packing 10 (shown schematically) is disposed within the cover 7 about the shaft 2.

Figure 2:
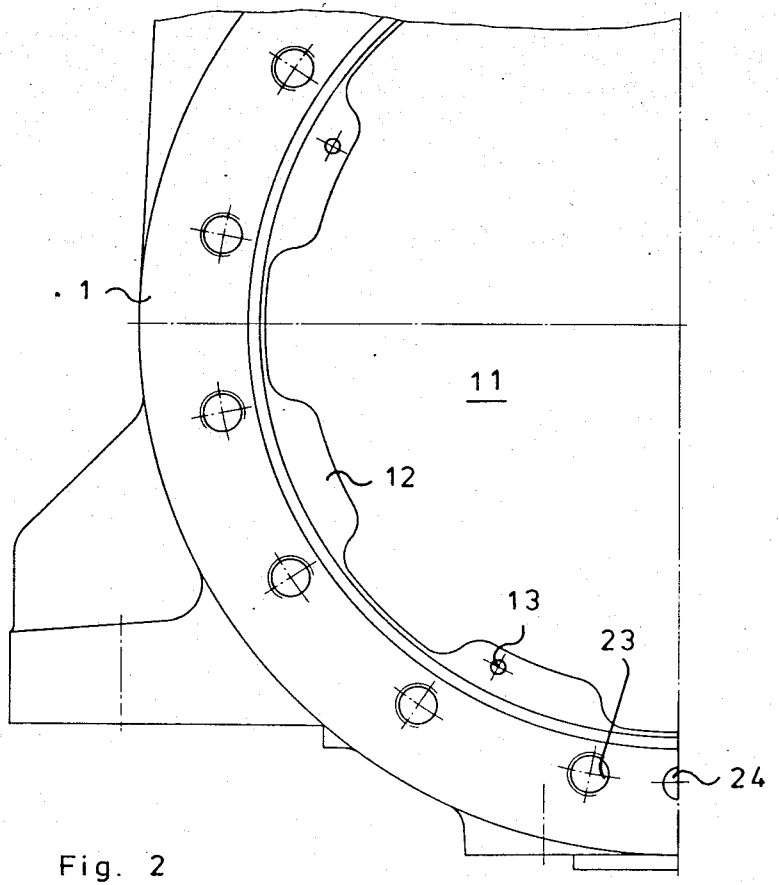
FIG. 2 illustrates a view taken on line 2—2- of and FIG. 1.

Referring to FIGS. 1 and 2 a serration in the form of a plurality of radially inwardly directed and circumferentially spaced teeth 12 is disposed at the open end of the housing 1 at the edge of the inner cavity 11. As indicated in FIG. 2, the teeth 12 are evenly distributed about the circumference of the housing 1. In addition, every other tooth 12 is provided with an axially disposed bore 13 which is situated eccentrically therein.

Figure 3:
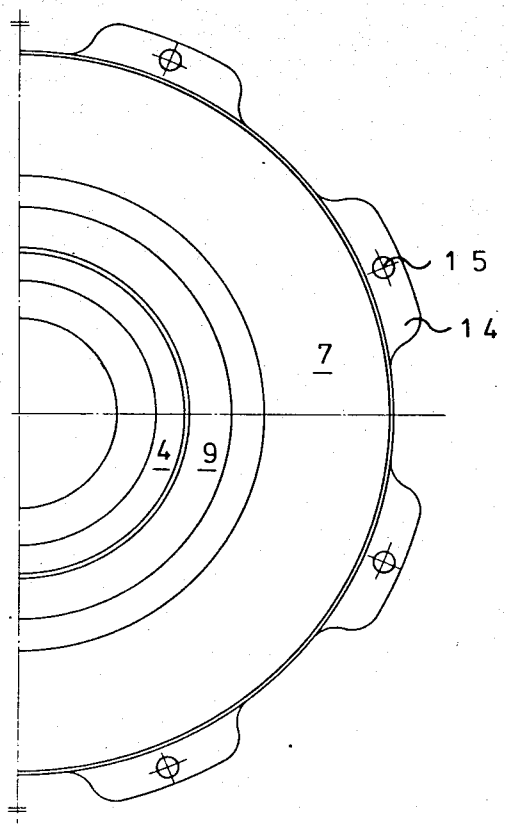
FIG. 3 illustrates a view taken on line 3—3 of FIG. 1.

Referring to FIGS. 1 and 3 a serration in the form of a plurality of radially outwardly directed and circumferentially spaced teeth 14 is disposed on the cover 7 at the innermost end relative to the housing 1. As shown in FIG. 1, the cover 7 is of a diameter which corresponds to the clearance of the housing serration, i.e. the outwardly directed teeth 14 of the cover are disposed in coaxial abutting relation with the teeth 12 on the housing 1.

As indicated in FIGS. 2 and 3, the form and position of the teeth 12, 14 are matched so that the teeth 14 of the pressure cover 7 can be introduced between the teeth 12 into the housing 1.

The teeth 14 of the cover 7 are each provided with an axially disposed bore 15 through which bolts 16 may pass when the rotor assembly, stator assembly and cover 7 are to form a slide-in unit for mounting within the housing 1. To this end, the stator assembly is provided with means, such as fishplates 17 having threaded bores 18 therein to receive the bolts 16. In this way, the cover 7 is secured to the stator 6 of the last stage.

After mounting of the slide-in unit, the bolts 16 are unscrewed and removed before the teeth 12,14 are brought into abutment with one another by the rotation of the cover 7 relative to the housing 1. In this regard, the pressure cover 7 is rotated, for example, by $\pi/8$ radians.

Referring to FIG. 1, a flange ring 21 circumferentially surrounds the cover 7 and is secured to the end of the housing 1 in order to close the radial gap between the housing 1 and the pressure cover 7. As indicated, the flange ring 21 is provided with bores through which bolts 22 may pass into threaded engagement with threaded bores 23 in the end of the housing 1.

In addition, an annular groove 19 is cut into the end face of the housing 1 to receive a radial sealing means in the form of an O-ring 20 in order to seal the flange ring 21 relative to the housing 1. In like manner, the cover 7 is provided with a circumferential groove 19′ into which an axial sealing means, such as an O-ring 20′, is disposed to seal the flange ring 21 relative to the cover 7.

The correct and always equal positioning of the cover 7 relative to the housing 1 after each disassembly and re-assembly is ensured by a positioning pin 25 which engages in a bore 24 (see FIG. 2) in the end face of the housing 1 and makes sure that the flange ring 21 assumes the correct position relative to the housing. Adjustment of the cover 7 and the flange ring 21 relative to each other is then effected by an adjusting wedge 26 which is placed into corresponding cutouts in the cover 7 and ring 21, respectively (see FIG. 1).

During disassembly, after the flange ring 21 has been removed, one or more pressure lines of a hydraulic system (not shown) may be connected to the bores 13 in the teeth 12 of the housing 1 in order to inject a pressure medium between the teeth 12, 14 so as to separate the teeth 12, 14 from each other. Use of the hydraulic system is particularly useful where the teeth 12, 14 have been fixed together by sticking. Further, an axial clearance between the cover 7 and the stator 6 of the last stage allows rotation of the cover 7 without need for any axial movement during the mounting and disassembling rotations.

The invention thus provides a turbo machine housing and cover arrangement of relatively small size and of relatively simple construction.

Further, the invention provides an arrangement wherein the sealing means for the cover and housing arrangement can be readily replaced without need to disassemble the cover and/or housing.

What is claimed is:

1. In combination, a turbomachine housing an open end defining a cavity for receiving turbomachine components and a plurality of radially inwardly directed teeth circumferentially spaced at said end;

a cover disposed within said open end of said housing to close said cavity, said cover having a plurality of radially outwardly directed teeth coaxially abutting said teeth of said housing;

a flange ring circumferentially surrounding said cover and secured to said end of said housing;

a sealing means between said ring and said housing; and an sealing means between said ring and said cover.

2. The combination as set forth in claim 1 wherein at least some of said teeth on said cover include an axially disposed bore.

3. The combination as set forth in claim 1 wherein at least some of said teeth on said housing include an axially disposed bore.

4. In combination a turbomachine housing defining a cylindrical cavity at at least one end for receiving turbomachine components;

a plurality of inwardly directed circumferentially spaced teeth on said housing at said end;

a cover mounted in said housing at said end;

a plurality of outwardly directed circumferentially spaced teeth on said cover in coaxial abutment with said teeth on said housing to retain said cover axially within said housing;

a ring circumferentially surrounding said cover and secured to said housing at said end;

a radial sealing means between said ring and said housing; and an axial sealing means between said ring and said cover.

* * * * *

UNITED STATES PATENT AND TRADEMARK OFFICE

CERTIFICATE OF CORRECTION

PATENT NO. : 4,701,103

DATED : October 20, 1987

INVENTOR(S) : STEPHEN MEDGVESY

It is certified that error appears in the above-identified patent and that said Letters Patent is hereby corrected as shown below:

Column 2, line 55 change "of and" to -of-

Column 4, line 26 change "housing an" to -housing having an-

Signed and Sealed this

Tenth Day of May, 1988

*Attest:*

*Attesting Officer*

DONALD J. QUIGG

*Commissioner of Patents and Trademarks*